US010635050B2

(12) United States Patent
Fussinger et al.

(10) Patent No.: US 10,635,050 B2
(45) Date of Patent: Apr. 28, 2020

(54) COMPONENT FOR A TIMEPIECE MOVEMENT

(71) Applicant: Nivarox-FAR S.A., Le Locle (CH)

(72) Inventors: Alexandre Fussinger, Wavre (CH); Philippe Barfuss, Auvernier (CH)

(73) Assignee: Nivarox-FAR S.A., Le Locle (CH)

( * ) Notice: Subject to any disclaimer, the term of this patent is extended or adjusted under 35 U.S.C. 154(b) by 127 days.

(21) Appl. No.: 15/834,635

(22) Filed: Dec. 7, 2017

(65) Prior Publication Data

US 2018/0173165 A1 Jun. 21, 2018

(30) Foreign Application Priority Data

Dec. 20, 2016 (EP) ..... 16205455

(51) Int. Cl.

| | |
|---|---|
| ***G04B 31/012*** | (2006.01) |
| ***G04B 13/02*** | (2006.01) |
| ***G04B 43/00*** | (2006.01) |
| ***G04B 15/14*** | (2006.01) |
| ***G04B 1/16*** | (2006.01) |
| ***G04B 17/32*** | (2006.01) |

(52) U.S. Cl.

CPC ..... *G04B 31/012* (2013.01); *G04B 1/16* (2013.01); *G04B 13/026* (2013.01); *G04B 15/14* (2013.01); *G04B 17/32* (2013.01); *G04B 43/007* (2013.01)

(58) Field of Classification Search

CPC ..... G04B 31/012; G04B 1/16; G04B 13/026; G04B 15/14; G04B 17/32; G04B 43/007; G04B 13/02; G04D 3/0069

USPC ..... 368/322

See application file for complete search history.

(56) References Cited

U.S. PATENT DOCUMENTS

| | | | | |
|---|---|---|---|---|
| 9,377,760 | B2 * | 6/2016 | Von Gruenigen | G04B 1/16 |
| 2014/0198625 | A1 * | 7/2014 | Von Gruenigen | G04B 1/16 368/124 |
| 2018/0024499 | A1 * | 1/2018 | Charbon | G04B 1/16 368/322 |
| 2018/0024500 | A1 * | 1/2018 | Charbon | G04B 1/16 368/322 |

(Continued)

FOREIGN PATENT DOCUMENTS

| | | |
|---|---|---|
| CH | 338767 | 5/1959 |
| CH | 707 504 A2 | 7/2014 |
| CH | 707 505 A2 | 7/2014 |

(Continued)

OTHER PUBLICATIONS

European Search Report dated Jun. 14, 2017 in European Application 16205455.5, filed on Dec. 20, 2016 (with English Translation of Categories of cited documents).

(Continued)

*Primary Examiner* — Edwin A. Leon

(74) *Attorney, Agent, or Firm* — Oblon, McClelland, Maier & Neustadt, L.L.P.

(57) ABSTRACT

A pivot arbor for a timepiece movement including at least one pivot made of a non-magnetic metal material at at least one of its ends in order to limit its sensitivity to magnetic fields. The non-magnetic metal material is a non-magnetic light metal or a non-magnetic alloy of the light metal, and at least the external surface of the pivot is coated with an anodic oxide layer of the material, obtained by anodic growth.

14 Claims, 1 Drawing Sheet

(56) References Cited

U.S. PATENT DOCUMENTS

| | | | | |
|---|---|---|---|---|
| 2018/0024501 | A1* | 1/2018 | Fussinger | G04B 13/026 368/322 |
| 2018/0024502 | A1* | 1/2018 | Fussinger | G04B 13/026 368/322 |

FOREIGN PATENT DOCUMENTS

| | | | |
|---|---|---|---|
| CH | 707 986 | A2 | 10/2014 |
| DE | 10 2009 046 647 | A1 | 5/2011 |
| FR | 1.249.229 | | 12/1960 |
| FR | 1.439.940 | | 5/1966 |

OTHER PUBLICATIONS

"Eloxal-Verfahren—Wikipedia", XP055381527, Website—Extracted Jun. 14, 2017, https://de.wikipedia.org/w/index.php?title=Eloxal-Verfahren&oldid=158514634, 2016, 7 pages.

* cited by examiner

COMPONENT FOR A TIMEPIECE MOVEMENT

This application claims priority from European Patent Application No. 16205455.5 filed on Dec. 20, 2016, the entire disclosure of which is incorporated herein by reference.

FIELD OF THE INVENTION

The invention relates to a component for a timepiece movement and particularly to a non-magnetic pivot arbor for a mechanical timepiece movement and more particularly to a non-magnetic balance staff, pallet staff and escape pinion.

BACKGROUND OF THE INVENTION

The manufacture of a pivot arbor for a timepiece consists in performing bar turning operations on a hardenable steel bar to define various active surfaces (bearing surface, shoulder, pivots, etc.) and then in subjecting the bar-turned arbor to heat treatments comprising at least one hardening operation to improve the hardness of the arbor and one or more tempering operations to improve its tenacity. The heat treatment operations are followed by an operation of rolling the pivots of the arbors, which consists in polishing the pivots to the required dimensions. The hardness and roughness of the pivots are further improved during the rolling operation.

The pivot arbors, for example the balance staffs, conventionally used in mechanical timepiece movements are made of steel grades for bar turning which are generally martensitic carbon steels containing lead and manganese sulphides to improve their machinability. A known steel of this type, named 20AP, is typically used for these applications.

This type of material has the advantage of being easy to machine, in particular of being suitable for bar turning and, after hardening and tempering, has superior mechanical properties which are very advantageous for making timepiece pivot arbors. These steels have a high hardness, making it possible to obtain very good shock resistance, particularly after heat treatment. Typically, the hardness of arbor pivots made of 20AP steel can exceed 700 HV after heat treatment and rolling.

Although this type of material provides satisfactory mechanical properties for the horological applications described above, it has the drawback of being magnetic and capable of interfering with the working of a watch after being subjected to a magnetic field, particularly when the material is used to make a balance staff cooperating with a balance spring made of ferromagnetic material. This phenomenon is well known to those skilled in the art. It will also be noted that these martensitic steels are also sensitive to corrosion.

Attempts have been made to try to overcome these drawbacks with austenitic stainless steels, which have the peculiarity of being non-magnetic, namely paramagnetic or diamagnetic or antiferromagnetic. However, these austenitic steels have a crystallographic structure, which does not allow them to be hardened and to achieve levels of hardness and thus shock resistance compatible with the requirements necessary for making timepiece pivot arbors. The arbors obtained then exhibit marks or severe damage in the event of shocks, which will then have a negative effect on the chronometry of the movement. One means of increasing the hardness of these steels is cold working, however this hardening operation cannot achieve hardnesses of more than 500 HV. Consequently, for parts requiring pivots with a high shock resistance, the use of this type of steel remains limited.

Another approach for attempting to overcome these drawbacks consists in depositing hard layers of materials such as diamond-like-carbon (DLC) on the pivot arbors. However, there have been observed significant risks of delamination of the hard layer and thus the formation of debris which can move around inside the timepiece movement and disrupt the operation of the latter, which is unsatisfactory.

There are also known, from EP 2 757 423, pivot arbors made of an austenitic alloy of cobalt or nickel and having an outer surface hardened to a certain depth. However, such alloys may prove difficult to machine for the manufacture of pivot arbors. Moreover, they are relatively expensive because of the high cost of nickel and cobalt.

SUMMARY OF THE INVENTION

It is an object of the invention to overcome the aforementioned drawbacks by proposing a pivot arbor which both limits sensitivity to magnetic fields and can achieve an improved hardness compatible with the demands for wear and shock resistance required in the horological industry.

It is yet another object of the invention to provide a non-magnetic pivot arbor which can be manufactured simply and economically.

To this end, the invention relates to a pivot arbor for a timepiece movement comprising at least one pivot made of a non-magnetic metallic material, at at least one of its ends, to limit its sensitivity to magnetic fields.

According to the invention, said non-magnetic material is a non-magnetic light metal or a non-magnetic alloy of said light metal, and at least the external surface of said pivot is coated with an anodic oxide layer of said material.

The anodic oxide layer is obtained by growth during anodization and offers excellent adherence and a much higher hardness than the non-magnetic metal material.

Consequently, the pivot arbor according to the invention can combine the advantages of low sensitivity to magnetic fields and an improved hardness compatible with the demands for wear and shock resistance required in the horological industry.

In accordance with other advantageous features of the invention:

- the anodic layer formed has a thickness comprised between 2 μm and 50 μm, and preferably between 10 μm and 30 μm;
- the anodic layer formed preferably has a hardness greater than 300 HV, preferentially greater than 400 HV and more preferentially greater than 500 HV.

Moreover, the invention relates to a timepiece movement comprising a pivot arbor as defined above, and in particular a balance staff, a pallet staff and/or an escape pinion comprising an arbor as defined above.

Finally, the invention relates to a method for manufacturing a pivot arbor as defined above, comprising the following steps:

a) forming a pivot arbor comprising at least one pivot made of a non-magnetic metal material, at at least one of its ends, to limit its sensitivity to magnetic fields, said non-magnetic metal material being a non-magnetic light metal or a non-magnetic alloy of said light metal;

b) subjecting at least the external surface of said pivot to an anodizing treatment to grow on said surface an anodic oxide layer of said material by anodization.

In accordance with other advantageous features of the invention:

the anodic layer is formed in step b) to have a thickness comprised between 2 μm and 50 μm, preferably between 10 μm and 30 μm;

the anodizing treatment of step b) may be a conventional anodization process or a micro arc oxidation process.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

In the present description, the term "non-magnetic" means a paramagnetic or diamagnetic or antiferromagnetic material, whose magnetic permeability is less than or equal to 1.01.

An alloy of an element is an alloy containing at least 50% by weight of said element.

The invention relates to a component for a timepiece movement and particularly to a non-magnetic pivot arbor for a mechanical timepiece movement.

The invention will be described below with reference to an application to a non-magnetic balance staff 1. Of course, other types of timepiece pivot arbors may be envisaged such as, for example, timepiece wheel set arbors, typically escape pinions, or pallet staffs. Components of this type have a body with a diameter preferably less than 2 mm, and pivots with a diameter preferably less than 0.2 mm, with a precision of several microns.

Figure 1:
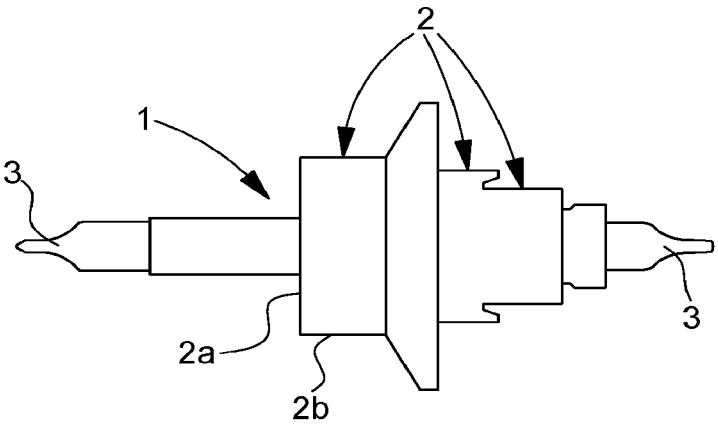
FIG. 1 is a representation of a pivot arbor according to the invention.
Figure 2:
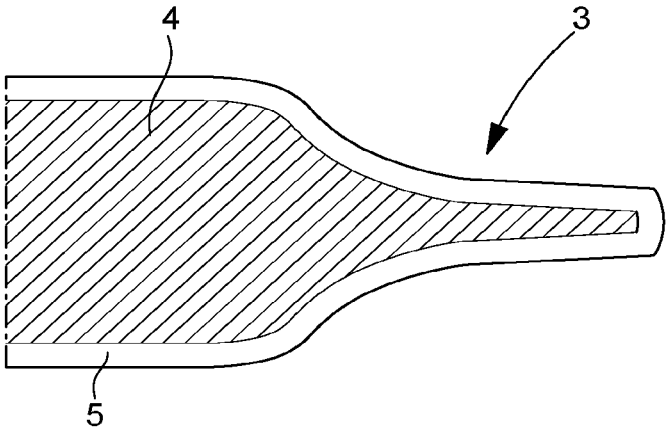
FIG. 2 is a partial cross-section of a balance staff pivot according to the invention.

Referring to FIG. 1, there is shown a balance staff 1 according to the invention, which comprises a plurality of sections 2 of different diameters, preferably formed by bar turning or any other chip removal machining technique, and defining, in a conventional manner, bearing surfaces 2*a* and shoulders 2*b* arranged between two end portions defining two pivots 3. These pivots are each intended to pivot in a bearing, typically in an orifice in a jewel or ruby.

With the magnetism induced by objects that are encountered on a daily basis, it is important to limit the sensitivity of balance staff 1 to avoid affecting the working of the timepiece in which it is incorporated.

Thus, pivot 3 is made of a first non-magnetic metal material 4, so as to advantageously limit the sensitivity of the pivot to magnetic fields.

According to the invention, said non-magnetic metal material 4 is a non-magnetic light material, or a non-magnetic alloy of said light metal.

Preferably, said non-magnetic metal material 4 used in the invention is chosen from the group comprising aluminium, titanium, magnesium and their non-magnetic alloys.

In a particularly advantageous manner, said non-magnetic metal material 4 is chosen from the group comprising a 6000-series aluminium alloy (Al Mg Si), a 7000-series aluminium alloy with copper (Al Zn Cu), a Grade 5 titanium alloy (containing from 5.5 to 6.75% of Al and 3.5 to 4.5% of V), an alloy of Mg—Zr, the proportions of the various alloying elements being chosen to give the alloys both non-magnetic properties and good machinability. These alloys have the property of being able to be bar turned and of being suitable for anodization.

For example, a particularly preferred alloy is the aluminium alloy EN AW 6082, the aluminium alloy EN AW 7075, and the aluminium alloy EN AW 7068.

The composition values are given in weight percent. The elements with no indication of composition value are either the remainder (balance or major element) or elements whose percentage in the composition is less than 1% by weight.

Of course, other non-magnetic light metal alloys may be envisaged, provided the proportion of their constituents confers both non-magnetic properties and good machinability.

The non-magnetic light metal material used in the invention generally has a hardness of less than 250 HV, or even 100 HV. In addition to the advantage of being non-magnetic, this material has low inertia due to its low weight.

According to the invention, at least the external surface of said pivot 3 is coated with an anodic oxide layer of said material 5, grown by anodization. This oxide layer obtained by growth has excellent adherence to the base material of the pivot preventing any subsequent delamination during use. Said anodic oxide layer obtained by growth also has an improved hardness compatible with the demands for wear and shock resistance required in the horological industry.

Thus, the anodic layer 5 formed has a hardness advantageously greater than 300 HV, preferably greater than 400 HV, and more preferentially greater than 500 HV.

Advantageously, the anodic layer 5 formed may have a thickness comprised between 2 μm and 50 μm, preferably between 10 μm and 30 μm.

It is evident that other layers that do not have a hardening function can then be deposited on anodic layer 5. Thus, it is possible, for example, to deposit a lubrication layer on anodic layer 5.

Consequently, at least the outer surface of pivot 3 is hardened, i.e. the rest of the arbor may remain little modified or unmodified without any significant change in the mechanical properties of balance staff 1. This selective hardening of pivots 3 of balance staff 1 makes it is possible to combine advantages, such as low sensitivity to magnetic fields, hardness and high tenacity, in the main areas of stress, while offering good corrosion and fatigue resistance.

The invention also relates to the method of manufacturing a balance staff as explained above. The method of the invention advantageously comprises the following steps:

a) forming, preferably by bar turning or any other chip removal machining technique, a balance staff 1 comprising at least one pivot 3 made of a non-magnetic metal material at each of its ends, to limit its sensitivity to magnetic fields; said non-magnetic metal material being a non-magnetic light metal or a non-magnetic alloy of said light metal;

b) subjecting at least the external surface of said pivot 3 to an anodizing treatment to grow on said surface an anodic oxide layer of said material by anodization to form at the surface of said pivot 3 a hard layer at least on the main stress areas.

Preferably, anodic oxide layer 5 is formed by anodization in step b) to have a thickness comprised between 2 μm and 50 μm, preferably between 10 μm and 30 μm.

Advantageously, the anodizing treatment of step b) is a conventional anodization process or a micro arc oxidation process.

Conventional anodization is performed by applying a continuous current to the system. There are different types of conventional anodization which may be performed, for example, in an oxalic or sulfuric medium. An oxalic medium is preferred. The different parameters of conventional anodization to be considered, such as the electrolyte bath composition, and particularly the choice and concentration of acid, the operating conditions, such as the temperature of the electrolyte, the pH, the intensity of the anodizing current, to obtain an anodic oxide layer of suitable thickness and hardness for the invention, are known to those skilled in the art.

Conventional anodizing treatments for aluminium may be as follows:

Treatment 1:

Bath 1

$H_2SO_4$: 150 g/l±5

$Al^{3+}$: 20 g/l±5

Temperature: 8° C.±3

Current intensity 1.5 A/dm$^2$±0.5

Treatment 2:

Bath 2

$H_2SO_4$: 150 g/l±10

Oxalic acid 50 g/l±10

Temperature: 16° C.±2

Current intensity 1 A/dm$^2$±0.5

Conventional anodizing treatments for titanium are carried out in accordance with standard AMS 2488 with an alkaline anodization process. The thickness of the anodic layer is around 3 μm.

Micro arc oxidation (MAO) is an electrolyte surface treatment process based on the principle of conventional anodization but differing from the latter as regards both the electrical power and the nature of the electrolyte. It causes micro-plasma discharges to appear at the surface of the material during treatment. Plasma electrolytic oxidation processes are generally carried out in low concentration alkaline baths with current densities generally lower than 1 A/cm$^2$ and voltages higher than 200 V. Those skilled in the art know how to choose parameters relating, in particular, to the electrical power, namely the current mode (current density, frequency and wave shape), the charge density and the current density, and to the aqueous based electrolytes (composition and concentration) to obtain an anodic oxide layer of suitable thickness and hardness for the invention.

The method according to the invention can comprise a preliminary surface treatment step necessary for cleaning the arbors before subjecting them to anodization.

The pivot arbor according to the invention may comprise pivots treated in accordance with the invention by applying step b) only to the pivots or be made entirely of a non-magnetic light metal material, its external surface could be entirely coated with an anodic oxide layer of said material by applying step b) to all the surfaces of the pivot arbor, The method according to the invention may also comprise, after step b), a finishing treatment step c). The finishing treatment may be a rolling or polishing operation to obtain the final surface state desired for pivots 3. In the particular case of micro arc oxidation, the finishing treatment may be a lapping operation to remove the porous surface layer.

The following example illustrates the present invention without thereby limiting its scope.

Balance staffs made of 6082 aluminium are made in a known manner and treated according to the method of the invention with conventional anodizing treatment 1:

Bath 1:

$H_2SO_4$: 150 g/l±5

$Al^{3+}$: 20 g/l±5

Temperature: 8° C.±3

Current intensity 1.5 A/dm$^2$±0.5

After conventional anodizing treatment, the 6082 aluminium balance staff is coated with an anodic aluminium oxide layer of 5.8 μm thickness. The core hardness is measured at 119 HV0.01. The hardness in the anodic oxide layer is measured at 695 HV0.01. There is obtained a light metal (aluminium) balance staff that combines the advantages of low sensitivity to magnetic fields, high hardness and tenacity, in the main stress areas, while having good corrosion and fatigue resistance.

What is claimed is:

1. A pivot arbor for a timepiece movement comprising:

at least one pivot made of a non-magnetic metal material, at at least one of the ends thereof, to limit the sensitivity thereof to magnetic fields, wherein said non-magnetic metal material is a non-magnetic light metal or a non-magnetic alloy of said light metal, and wherein at least the external surface of said pivot is coated with an anodic oxide layer of said material.

2. The pivot arbor according to claim 1, wherein the arbor is made of a non-magnetic metal material, said non-magnetic metal material being a non-magnetic light metal or a non-magnetic alloy of said light metal in order to limit the sensitivity thereof to magnetic fields, and wherein the external surface thereof is coated with an anodic oxide layer of said material.

3. The pivot arbor according to claim 1, wherein the non-magnetic metal material is chosen from the group consisting of aluminium, titanium, magnesium and their non-magnetic alloys.

4. The pivot arbor according to claim 1, wherein the non-magnetic metal material has a hardness of less than 250 HV.

5. The pivot arbor according to claim 1, wherein the anodic oxide layer has a thickness comprised between 2 μm and 50 μm.

6. The pivot arbor according to claim 5, wherein the anodic oxide layer has a thickness comprised between 10 μm and 30 μm.

7. The pivot arbor according to claim 1, wherein said anodic oxide layer has a hardness greater than 300 HV.

8. The pivot arbor according to claim 7, wherein said anodic oxide layer has a hardness greater than 400 HV.

9. The pivot arbor according to claim 8, wherein said anodic oxide layer has a hardness greater than 500 HV.

10. The pivot axis according to claim 1, wherein the non-magnetic metal material is chosen from the group consisting of a 6000-series aluminium alloy, a 7000-series aluminium alloy with copper, a Grade 5 titanium alloy, and an Mg—Zr alloy.

11. A movement for a timepiece, wherein the movement comprises the pivot arbor according to claim 1.

12. A movement for a timepiece, wherein the movement comprises a balance staff, a pallet staff and/or an escape pinion comprising the pivot arbor according to claim 1.

13. The pivot arbor according to claim 1, wherein the pivot arbor has a diameter of less than 2 mm.

14. The pivot arbor according to claim 1, wherein the pivot arbor is a balance staff.

* * * * *